US009863636B2

(12) United States Patent
Farley et al.

(10) Patent No.: US 9,863,636 B2
(45) Date of Patent: Jan. 9, 2018

(54) FUEL-FIRED HEATING APPLIANCE HAVING FLAME INDICATOR ASSEMBLY

(71) Applicant: Rheem Manufacturing Company, Atlanta, GA (US)

(72) Inventors: Darryl Farley, Fort Smith, AR (US); Shawn Reed, Charleston, AR (US); Robert Neihouse, Fort Smith, AR (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 436 days.

(21) Appl. No.: 14/457,759

(22) Filed: Aug. 12, 2014

(65) Prior Publication Data

US 2016/0047548 A1 Feb. 18, 2016

(51) Int. Cl.

| | |
|---|---|
| ***F23N 1/00*** | (2006.01) |
| ***F23N 5/24*** | (2006.01) |
| ***F24D 19/10*** | (2006.01) |
| ***F23N 5/12*** | (2006.01) |

(52) U.S. Cl.

CPC ..... *F23N 5/242* (2013.01); *F23N 5/123* (2013.01); *F24D 19/1084* (2013.01); *F23D 2208/10* (2013.01); *F23N 2029/00* (2013.01); *F23N 2031/22* (2013.01)

(58) Field of Classification Search

USPC ..... 126/116 A; 431/78, 18

See application file for complete search history.

(56) References Cited

U.S. PATENT DOCUMENTS

| | | | | |
|---|---|---|---|---|
| 4,641,631 | A * | 2/1987 | Jatana | F23C 3/004 122/18.3 |
| 4,823,114 | A * | 4/1989 | Gotisar | F23N 5/082 340/578 |
| 4,904,986 | A | 2/1990 | Pinckaers | |
| 5,153,673 | A | 10/1992 | Amirav | |
| 5,164,600 | A * | 11/1992 | Das | F23N 5/082 250/226 |
| 5,518,396 | A * | 5/1996 | Muzzolini | F23N 5/102 331/66 |
| 5,813,849 | A | 9/1998 | Schwartz et al. | |
| 6,354,830 | B1 * | 3/2002 | de Nanclares | F23N 5/203 431/18 |
| 7,280,891 | B2 | 10/2007 | Chase et al. | |
| 7,289,032 | B2 | 10/2007 | Seguin et al. | |
| 7,764,182 | B2 | 7/2010 | Chian et al. | |
| 7,806,682 | B2 | 10/2010 | Cueva | |

(Continued)

*Primary Examiner* — Avinash Savani

(74) *Attorney, Agent, or Firm* — King & Spalding LLP

(57) ABSTRACT

A flame indicator assembly for a fuel-fired heating appliance, the fuel-fired heating appliance including a burner assembly and control electronics. The flame indicator assembly comprises a flame sensor configured to allow the flow of electric current in response to exposure to a flame. The flame sensor is configured for electrical communication with the control electronics of the fuel-fired heating appliance. The flame indicator assembly also comprises a visual indicator module attached to the flame sensor. The visual indicator module comprises at least one light source. The visual indicator module is in operative communication with the flame sensor such that the at least one light source is actuated in response to the flow of electric current. A fuel-fired heating appliance comprising a flame indicator assembly is also disclosed.

23 Claims, 9 Drawing Sheets

(56) References Cited

U.S. PATENT DOCUMENTS

| | | | | |
|---|---|---|---|---|
| 7,956,329 | B2 * | 6/2011 | Laluvein | G08B 17/12 250/339.15 |
| 8,274,560 | B2 | 9/2012 | Galfrascoli et al. | |
| 8,333,584 | B2 * | 12/2012 | Cook | F24H 9/2035 122/14.2 |
| 2002/0048736 | A1 * | 4/2002 | Kawauchi | F23N 5/242 431/24 |
| 2004/0174265 | A1 | 9/2004 | Kociecki et al. | |
| 2011/0262704 | A1 | 10/2011 | Rock et al. | |
| 2012/0178031 | A1 * | 7/2012 | Roy | F23D 14/62 431/12 |
| 2012/0288806 | A1 * | 11/2012 | Racaj | F23N 5/123 431/18 |
| 2016/0047548 | A1 * | 2/2016 | Farley | F23N 5/242 126/116 A |

* cited by examiner

FUEL-FIRED HEATING APPLIANCE HAVING FLAME INDICATOR ASSEMBLY

BACKGROUND

The present invention relates generally to fuel-fired heating appliances, such as furnaces and water heaters. More specifically, embodiments of the invention provide systems and methods for visually indicating that a flame is present in a burner assembly of a fuel-fired heating appliance without the need to visually observe the flame itself.

Draft-induced, fuel-fired furnaces, such as gas-fired air heating furnaces, are conventionally provided with heat exchangers having multiple combustor tubes with inlets arranged in a row. The row of heat exchanger combustor tube inlets is typically served by one or more fuel burners, which may be of the inshot type, arranged in a row facing and parallel to the row of heat exchanger combustor tube inlets. During operation of the furnace, gaseous fuel is drawn into the burners from an external fuel source, mixed with primary combustion air drawn into the interior of the burners, ignited, and then drawn into and through the heat exchanger combustor tubes. At the same time, a blower portion of the furnace forces a flow of air being recirculated to and from a conditioned space served by the furnace externally over the heat exchanger combustor tubes to transfer combustion heat from the tubes to the recirculating air.

Various jurisdictions have regulations regarding the safety and operation of fuel-fired heating appliances. For example, gas furnaces sold in the U.S. and Canada are required to be constructed in such a way as to permit observation of the burner flames, both during adjustment and under operating conditions. In this regard, before the advent of induced draft furnaces, being able to view the flame from a position outside the burner assembly (or, in some cases, the furnace itself) facilitated adjustments by service personnel to ensure that the burner has enough oxygen and burns properly.

In some fuel-fired heating appliances, however, it is either very difficult or impossible to visually observe the presence or absence of a burner flame from a position outside the burner assembly without removing the furnace components. In particular, certain appliances designed to reduce the emission of Nitrogen Oxide ($NO_x$) have burner assemblies which are either partially or totally enclosed. Accordingly, visual observation of the burner flame is impeded. In the past, to meet the above requirement, these fuel-fired heating appliances included a sight glass inserted into a burner assembly wall and/or furnace cabinet or door which allowed visual inspection of the flame itself.

Those of skill in the art should be familiar with methods for detecting the presence or failure of a flame in fuel-fired heating appliances. In this regard, rectification flame sensors (sometimes referred to as ionization flame sensors) are widely used in fuel-fired heating appliances to detect the presence or failure of a flame. In general, rectification flame sensors rely on the electrical properties of a hydrocarbon flame to detect the status of a flame. These flame sensors, which are typically coupled with the burner assembly, are in electronic communication with a control board that controls the fuel-fired heating appliance based on the status of the flame, such as by shutting off fuel flow when a flame has failed. Additional information regarding the operation of rectification flame sensors is provided in U.S. Pat. Nos. 4,427,363; 5,472,336; 6,509,838; 7,764,182; and 7,806,682, the entire disclosures of each of which are incorporated by reference herein for all purposes. However, currently available flame sensors do not provide a visual indication at the burner assembly of the presence or absence of a burner flame.

SUMMARY

The present invention recognizes and addresses various considerations of prior art constructions and methods. According to one aspect, the present invention provides a flame indicator assembly for a fuel-fired heating appliance. The fuel-fired heating appliance comprises a burner assembly and control electronics. The flame indicator assembly comprises a flame sensor configured to allow the flow of electric current in response to exposure to a flame. The flame sensor is configured for electrical communication with the control electronics of the fuel-fired heating appliance. The flame indicator assembly also comprises a visual indicator module attached to the flame sensor. The visual indicator module comprises at least one light source. In some embodiments, the at least one light source is a light-emitting diode. The visual indicator module is in operative communication with the flame sensor such that the at least one light source is actuated in response to the flow of electric current.

According to another aspect, the present invention provides a flame indicator assembly for a fuel-fired heating appliance. The fuel-fired heating appliance comprises a burner assembly and control electronics. The flame indicator assembly comprises an electrical circuit comprising a flame sensor that allows the flow of electric current in response to electrical characteristics of a flame when the flame is proximate to the flame sensor. The flame sensor comprises an elongated flame rod having a first end and a second end. The circuit comprises at least one light-emitting diode for providing a visual indication of the existence of a flame. The at least one light-emitting diode is attached to the flame rod first end. The circuit operatively connects the flame sensor to the at least one light-emitting diode so that the circuit actuates the at least one light-emitting diode in response to the flow of electric current. The flame indicator assembly also comprises a mounting bracket to which the flame sensor and the at least one light-emitting diode are attached and that is configured to be attached to the burner assembly.

In yet another aspect, the present invention provides a fuel-fired heating appliance. The fuel-fired heating appliance comprises a housing and a burner assembly disposed in the housing. The burner assembly comprises at least one burner. The fuel-fired heating appliance also comprises a heat exchanger assembly disposed in the housing. The heat exchanger assembly comprises at least one combustor tube located proximate the at least one burner. Additionally, the fuel-fired heating appliance comprises control electronics disposed in the housing and configured to control actuation of the burner assembly. A flame indicator assembly is coupled with the burner assembly. The flame indicator assembly comprises a flame sensor configured to allow the flow of electric current in response to exposure to a flame in the burner assembly. The flame sensor is in electrical communication with the control electronics. The flame indicator assembly also comprises a visual indicator module attached to the flame sensor. The visual indicator module comprises at least one light source. The visual indicator module is in operative communication with the flame sensor such that the at least one light source is actuated in response to the flow of electric current.

Those skilled in the art will appreciate the scope of the present invention and realize additional aspects thereof after reading the following detailed description of preferred embodiments in association with the accompanying drawing figures.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
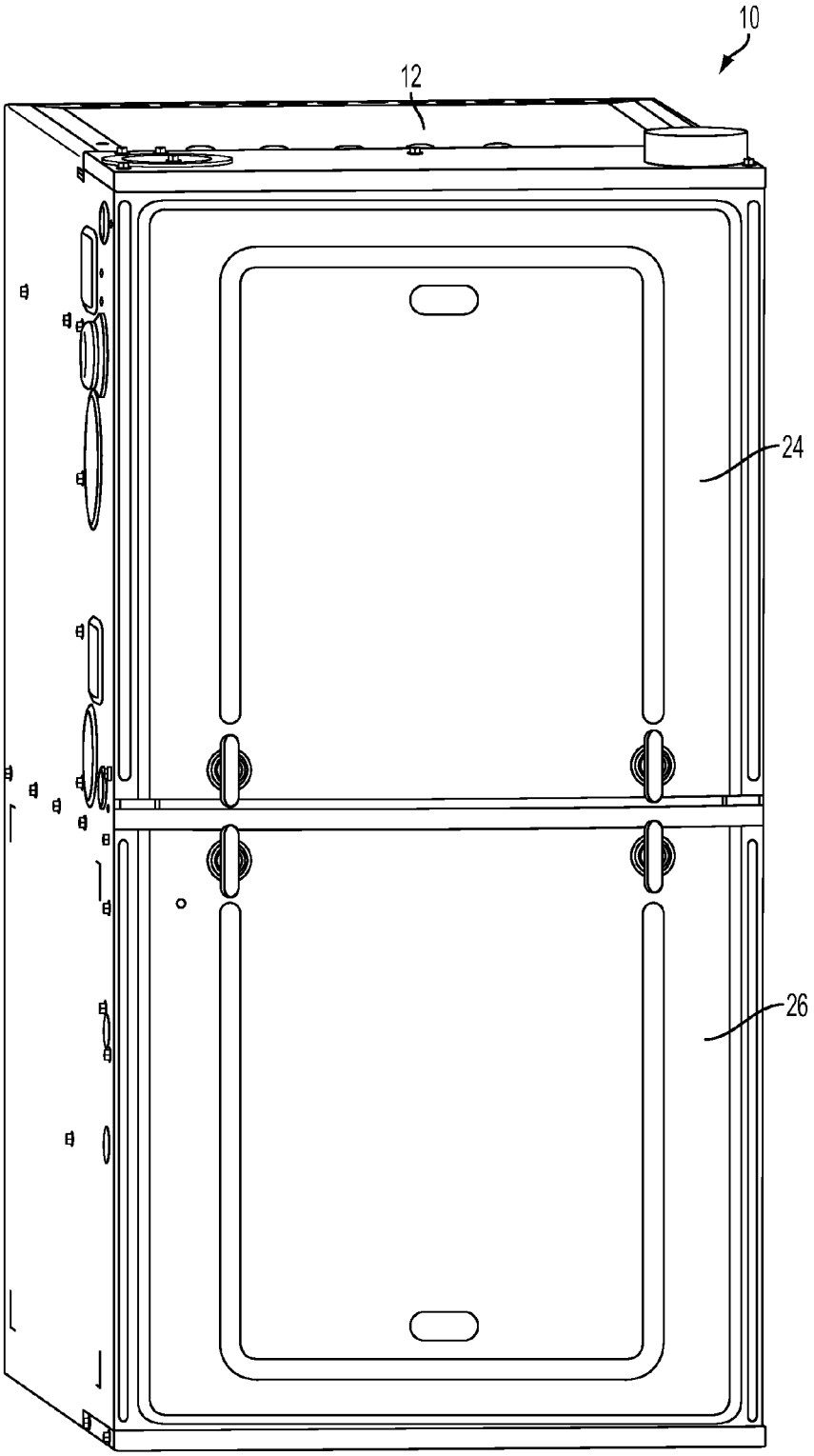
FIG. 1 PRIOR ART
FIG. 1 is a perspective view of a prior art fuel-fired furnace.

Repeat use of reference characters in the present specification and drawings is intended to represent same or analogous features or elements of the invention.

DETAILED DESCRIPTION OF PREFERRED EMBODIMENTS

Reference will now be made in detail to one or more embodiments of the present invention, one or more examples of which are illustrated in the accompanying drawings. Each example is provided by way of explanation of the invention, not limitation of the invention. In fact, it will be apparent to those skilled in the art that modifications and variations can be made in such embodiments without departing from the scope or spirit of the present invention. For instance, features illustrated or described as part of one embodiment may be used on another embodiment to yield a still further embodiment. Thus, it is intended that the present invention covers such modifications and variations as come within the scope of the appended claims and their equivalents.

Some embodiments of the present invention may be particularly suitable for use with a fuel-fired furnace, and the discussion herein describes some embodiments in that context. However, those of skill in the art will understand that the present invention is not so limited. In fact, it is contemplated that embodiments of the present invention may be used with any fuel-fired heat transfer apparatus, for example water heaters, pool heaters, and boilers, among others. Likewise, although some embodiments of the present invention are discussed below with reference to a rectification flame sensor, those of skill in the art will appreciate that other embodiments of the present invention may be used with other types of flame sensor, including thermocouple-based, infrared, near infrared, ultraviolet, visible light, and camera flame sensors, among others.

Figure 2:
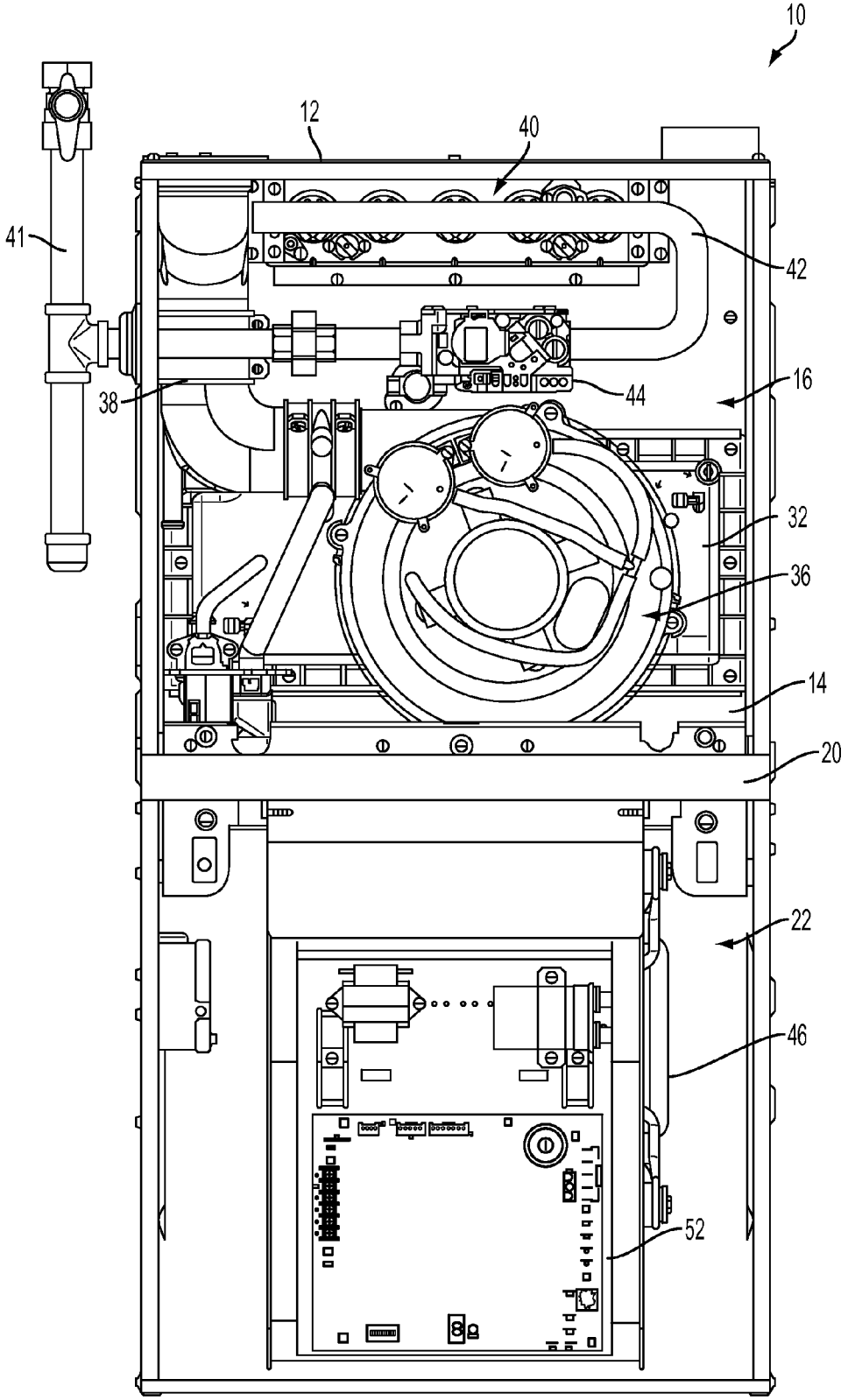
FIG. 2 PRIOR ART
FIG. 2 is a front elevation view of the fuel-fired furnace of FIG. 1, shown with the cabinet doors removed.
Figure 3:
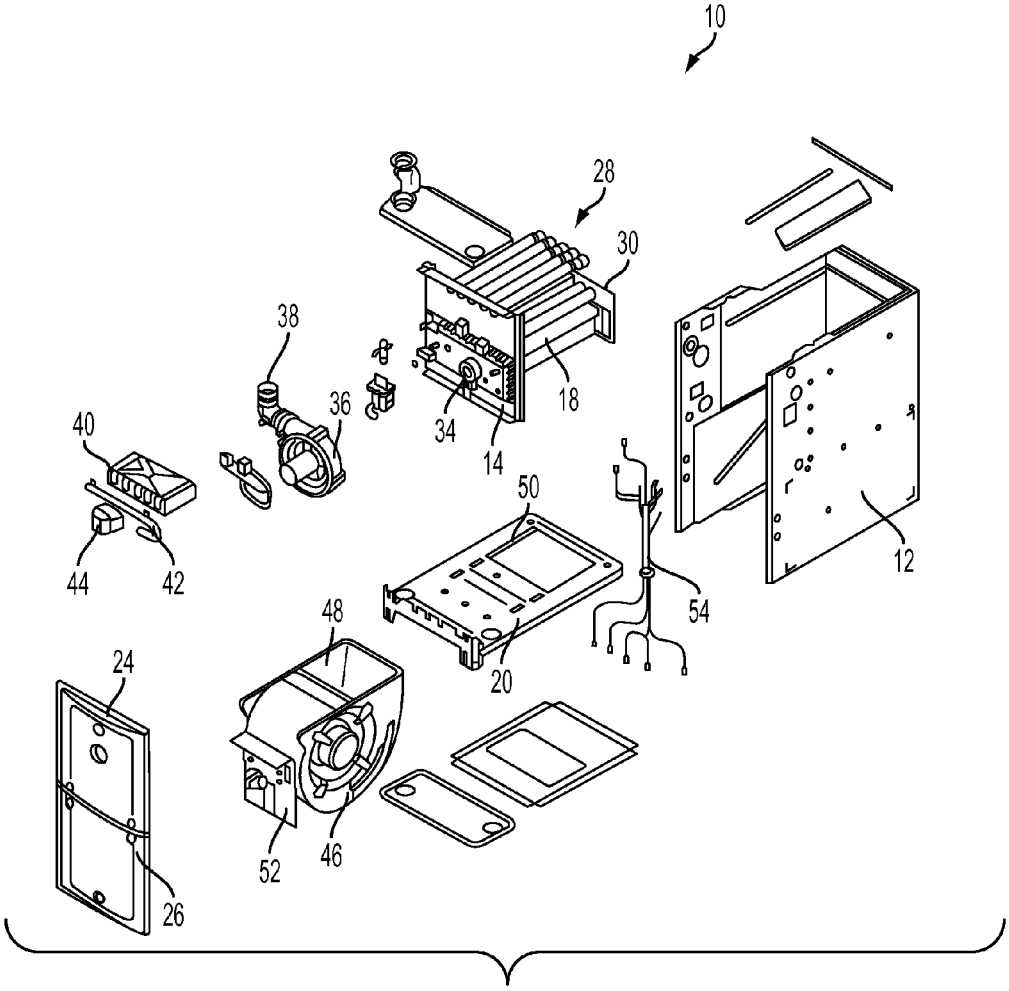
FIG. 3 PRIOR ART
FIG. 3 is an exploded view of the fuel-fired furnace of FIG. 1.

As an initial matter, the general operation of a prior art fuel-fired heating appliance is described with reference to FIGS. 1-3. In particular, the heating appliance illustrated in these figures is a gas-fired, forced air furnace 10. Furnace 10 may be, in one example, similar to the R96VA model condensing two-stage gas furnace offered by Rheem Manufacturing Company of Atlanta, Ga. In general, furnace 10, which is shown here in an upflow configuration but may also be used in horizontal and downflow configurations, comprises a housing 12 with a cross section of a generally rectangular shape having upper and lower ends to which supply and return air ductwork (not illustrated) is operatively connected. A vertical wall 14 extends within housing 12 to define a supply plenum and a burner chamber 16. A heat exchanger assembly 18 is positioned within the supply plenum. Similarly, a horizontal wall 20 extends within housing 12 to define a blower chamber 22 which also serves as an inlet plenum. Housing 12 may comprise upper and lower doors 24, 26, which respectively open to burner chamber 16 and blower chamber 22.

Heat exchanger assembly 18 comprises a plurality of combustor tubes 28 which are horizontally spaced apart and vertically serpentine. In FIG. 3, five such combustor tubes 28 are shown. Combustor tubes 28 are secured at their inlet ends to an upper portion of vertical wall 14. The outlet ends of combustor tubes 28 are connected to a transition box 30, which is positioned in a lower portion of the supply plenum. A collector box 32 is mounted on vertical wall 14 in generally horizontal facing relationship with transition box 30, and a secondary heat exchanger (which may be of the condenser type) extends therebetween. An outlet 34 of collector box 32 is in fluid communication with an inlet of a draft inducer fan 36, which is disposed in burner chamber 16. Draft inducer fan 36 has an outlet 38 connectable to an exterior vent stack (not illustrated). Additional information regarding the operation of heat exchangers in gas-fired, forced air furnaces is provided in U.S. Pat. No. 5,406,933, the entire disclosure of which is incorporated by reference herein for all purposes.

A burner assembly 40 is supported by fasteners to vertical wall 14 in the upper portion of burner chamber 16. In furnace 10, burner assembly 40 comprises a plurality of "in-shot" type gas burners which are supplied with hydrocarbon fuel (such as natural gas) through fuel supply piping 41 coupled to a supply manifold 42. A gas valve 44, which may be a DC milliamp, constant current control type gas valve, is coupled along the fuel supply piping upstream of manifold 42. The gas burners are spaced outwardly apart from, and face, the open inlet ends of associated combustor tubes 28. As is well known, the gas burners are operative during firing of furnace 10 to flow flames and hot combustion gases into the inlet ends of combustor tubes 28.

Further, a blower assembly 46 for forcing supply air across heat exchanger assembly 18 is secured in blower chamber 22 below horizontal wall 20. An outlet 48 of blower assembly 46 may be coupled with an opening 50 defined in horizontal wall 20 beneath heat exchanger assembly 18. Blower assembly 46 may comprise a variable-speed electronically commutated motor, which may facilitate two-stage operation. Finally, a control board assembly 52 may be disposed in front of blower assembly 46 in blower chamber 22. Control board assembly 52 includes control electronics to control the operation and various components of furnace 10, as is well known. A wiring harness 54 (FIG. 3), which as shown may extend between blower chamber 22 and burner chamber 16, provides electronic communication between the control circuitry of control board assembly 52 and the various components of furnace 10.

In operation, upon a demand for heat from furnace 10 by a thermostat (not illustrated) located in the space to be heated and in electronic communication with control board assembly 52, the burners of burner assembly 40 and the draft inducer fan 36 are energized. Flames and resulting combustion products from the burners are directed into the open inlet ends of combustor tubes 28, and the combustion products are drawn through the heat exchanger assembly 18 by the operation of draft inducer fan 36. In particular, the received combustion products are drawn sequentially through serpentine primary combustor tubes 28, transition box 30, the secondary heat exchanger, and collector box 32. Combustion products entering the draft inducer fan 36 from collector box 32 are discharged from fan 36 into the associated vent stack.

At the same time, blower assembly 46 draws return air from the conditioned space served by furnace 10 upwardly through return ductwork connected to an opening in the bottom of housing 12 and into blower chamber 22. Air entering chamber 22 enters the inlet of blower assembly 46 and is forced upwardly through opening 50 in horizontal wall 20 and then externally across heat exchanger assembly 18. As it traverses heat exchanger assembly 18, the air receives combustion heat from heat exchanger assembly 18. The heated air then exits housing 12 into supply ductwork for delivery to the conditioned space served by furnace 10.

Figure 4:
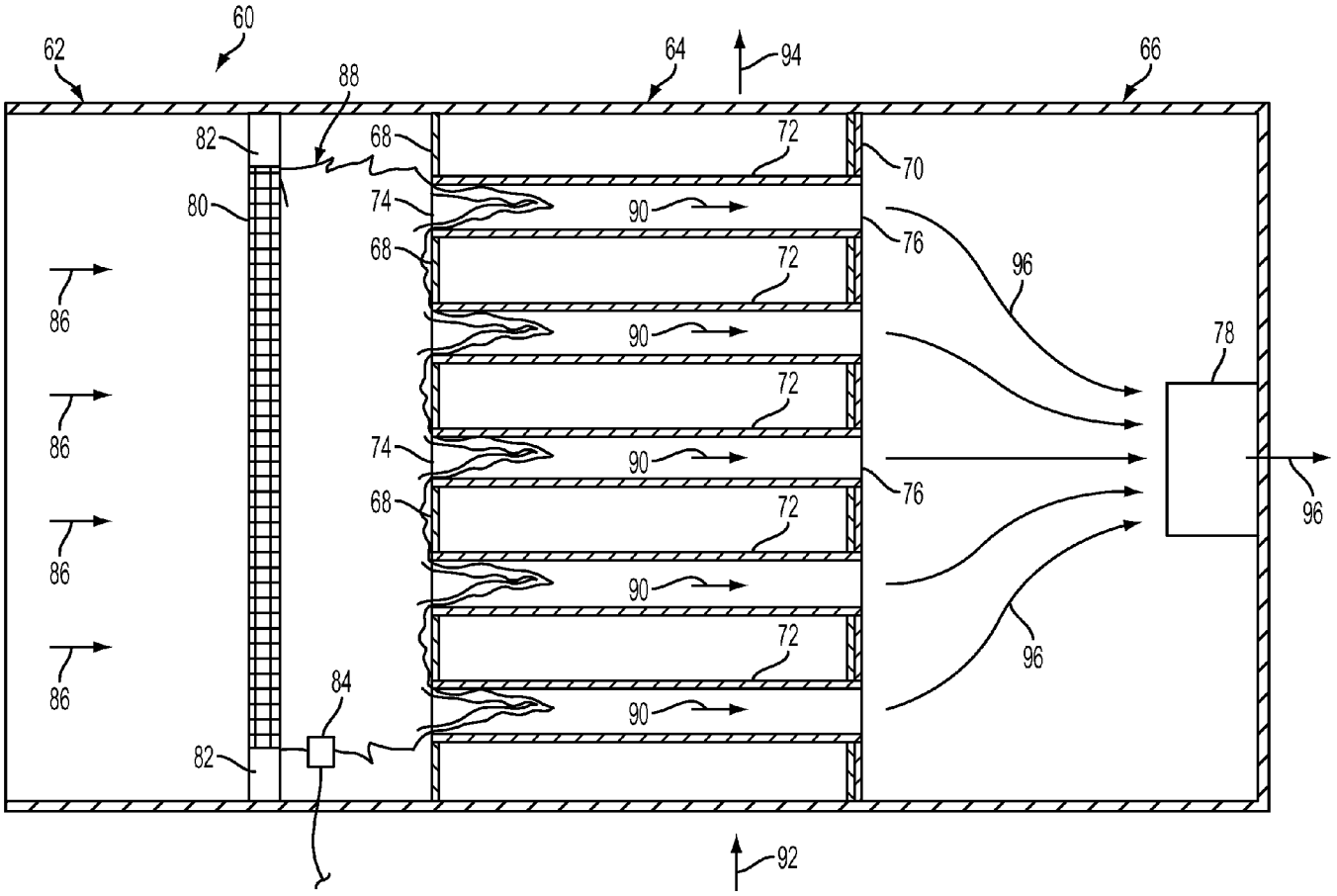
FIG. 4 PRIOR ART
FIG. 4 is a schematic cross-sectional view of a prior art fuel-fired heating appliance having a premix burner assembly.

As explained above, in some furnaces (particularly those designed to reduce NOx emissions or which include a separate, sealed combustion chamber), it is either difficult or impossible to visually observe the burner flames in the absence of a sight glass or viewport inserted in the burner assembly wall. For example, FIG. 4 is a schematic cross-sectional view of a portion of a gas-fired furnace illustrating a burner assembly 60. Burner assembly 60 is a premix burner assembly comprising a burner box 62, and it is coupled with a heat exchanger assembly 64 and a collector box 66. As shown, burner box 62 forwardly terminates at a rear wall 68 of heat exchanger assembly 64, and heat exchanger assembly 64 forwardly terminates at a rear wall 70 of collector box 66. Burner box 62 is positioned downstream of a mixing box (not shown in FIG. 4).

Heat exchanger assembly 64 comprises five combustor tubes 72. Combustor tubes 72 extend through the interior of heat exchanger assembly 64 and have open rear inlet ends 74 supported in corresponding openings in rear wall 68 and open front outlet ends supported in corresponding openings in rear wall 70. An inlet 78 of a draft inducer fan is positioned in collector box 66. A rectangular, flat metal mesh burner 80 is positioned in burner box 62 in a rearwardly-spaced, facing relationship with the open inlet ends 74 of heat exchanger tubes 72. Burner 80 is carried within a suitable frame secured to an interior flange portion 82 of burner box 62. An igniter 84 extends into burner box 62 and is operatively associated with burner 80, as is well known.

During firing of the heating appliance with which burner 80 is associated, a flow 86 of pre-mixed fuel and air is forwardly drawn through burner box 62 to burner 80. At this point, the flow 86 is caused to combust by igniter 84 to form an elongated flame pattern 88 emanating from the front side of burner 80. As shown, portions of the flame pattern 88 form hot combustion gases 90. The balance of the flame pattern 88 is directed against wall 68.

At the same time, air 92 is suitably flowed externally across combustor tubes 72 to create heated air 94 for delivery to a conditioned space served by the heating appliance. The draft inducer fan draws cooled combustion gases 96 from combustor tube outlet ends 76, through the interior of collector box 66, into inlet 78, and eventually exhausts the cooled combustion gases 96 to a suitable flue.

As will be appreciated from FIG. 4, it is not possible to visually observe the status of flame pattern 88 during operation of burner assembly 60 because flame pattern 88 is completely enclosed by the burner assembly housing. To make it possible to view the status of flame pattern 88, it would be necessary to install a sight glass or viewport in the wall of burner assembly 60. The walls of premix burner assemblies, such as burner assembly 60, however, are often required to be lined with a thick refractory material. Thus, the sight glass would have to penetrate at least both the burner box 62 housing and the refractory material. Further, the high temperatures present in the burner box increase a risk that the sight glass may leak.

In contrast, embodiments of the present invention provide systems and methods for visually indicating that a flame is present in a burner assembly of a fuel-fired heating appliance without the need to visually observe the flame itself. In some embodiments, the visual indication may comprise one or more light-emitting diodes (LEDs) coupled with a flame sensor in a burner assembly. The LED(s) may be configured to be selectively lighted in response to the presence or absence of a flame in the burner assembly. Thus, embodiments of the present invention enable a user of the appliance to visually observe the status of a flame at the burner assembly, even where it is difficult or impossible for the user to view the flame itself.

Figure 5:
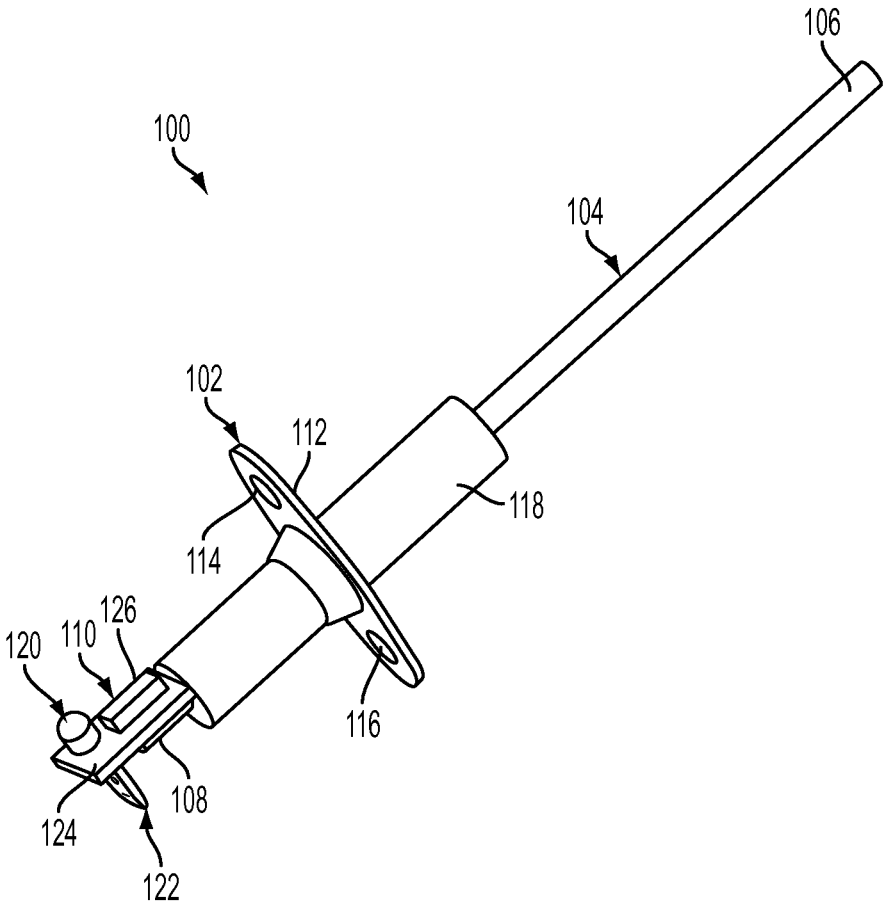
FIG. 5 is an isometric view of a flame indicator assembly constructed in accordance with an embodiment of the present invention.
Figure 6:
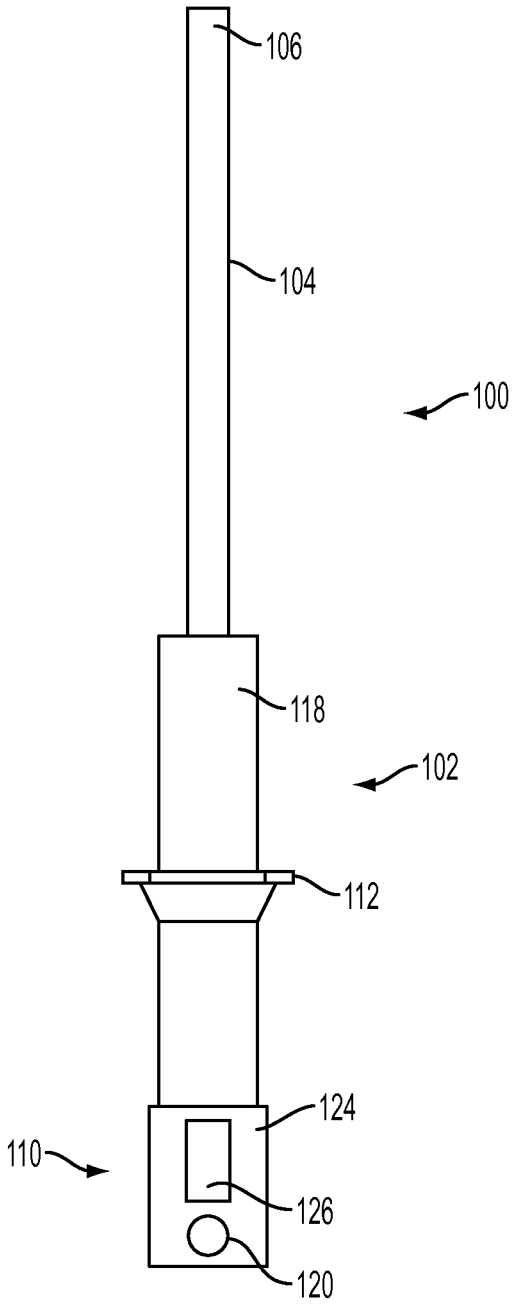
FIG. 6 is a top view of the flame indicator assembly of FIG. 5.
Figure 7:
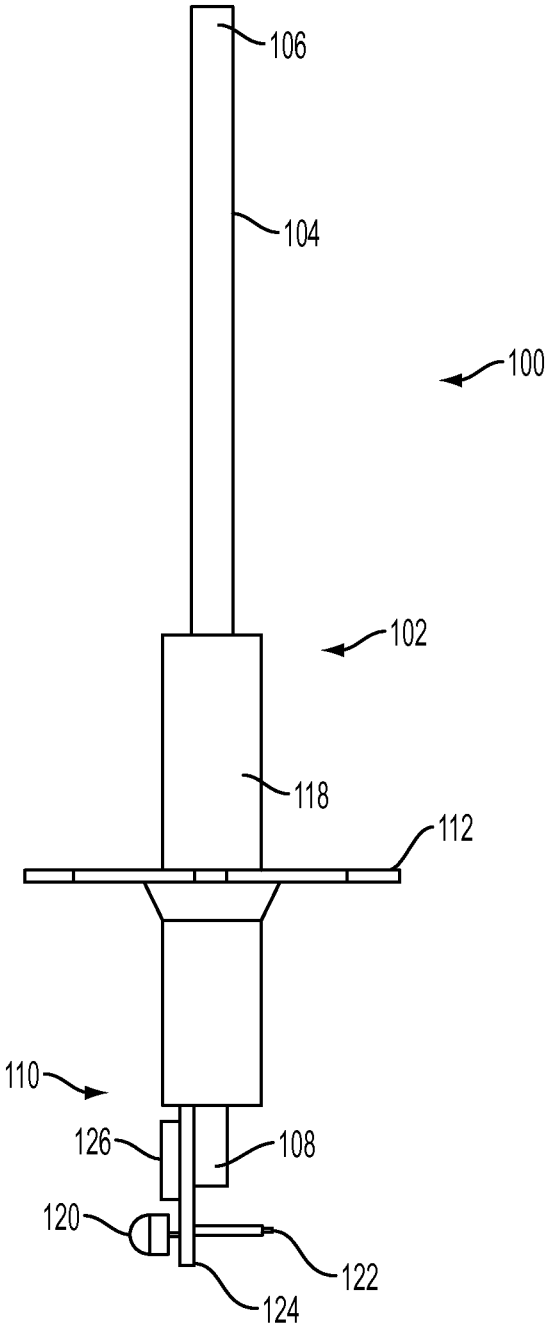
FIG. 7 is a right side view of the flame indicator assembly of FIG. 5.

Certain embodiments are discussed in more detail below with reference to FIGS. 5-7. In this regard, FIG. 5 is an isometric view of a flame indicator assembly 100 constructed in accordance with one embodiment of the present invention. FIGS. 6 and 7 are respective top and right side views of flame indicator assembly 100.

As shown, flame indicator assembly 100 preferably comprises a flame sensor 102 configured to allow the flow of electric current or generate an electrical signal in response to exposure to a flame. In the illustrated embodiment, flame sensor 102 may preferably be a rectification flame sensor, but as noted above, other embodiments may be used with different types of flame sensors having different configurations. Flame sensor 102 may include a flame rod 104, the distal end 106 of which may be inserted into a space or volume of the burner assembly in which a burner flame is expected to exist in normal operation of the furnace and a proximal end 108 of which is coupled with a visual indicator module 110. Further, flame sensor 102 comprises a mounting plate or bracket 112 which, in this embodiment, defines two apertures 114, 116, through which suitable fasteners may pass to secure flame indicator assembly 100 to a burner assembly. Mounting plate 112 is received over a ceramic insulator 118, which is in turn received over flame rod 104.

Visual indicator module 110 preferably comprises at least one visual indicator, which may be a light source such as LED 120. It will be appreciated that, in other embodiments, other suitable visual indicators are contemplated, including any suitable light source. Solid-state, incandescent, and fluorescent light sources, and digital displays, among others, are also specifically contemplated. Further, some embodiments may comprise a plurality of LEDs which may form a bar or a display.

In any event, visual indicator module 110 may also comprise at least one terminal 122, which as shown may be a quick-connect terminal. Terminal 122 is preferably in electrical communication with flame rod 104. In one embodiment, terminal 122 may be coupled with a circuit board 124 or another suitable substrate, which itself is operatively connected to proximal end 108 of flame rod 104. Further, LED 120 may be disposed on circuit board 124 and in electrical communication with terminal 122. In some embodiments, more than one terminal may be provided.

Terminal 122 may preferably enable electrical communication between flame sensor 102 and a control board or control electronics (e.g., control electronics 52, as in FIGS. 2 and 3) of a fuel-fired heating appliance with which flame indicator assembly 100 may be associated. Thereby, the appliance's control electronics evaluate the electrical characteristics of flame sensor 102 and make a determination regarding the status of a flame in a burner assembly, as is well known. In some embodiments, the evaluation of electrical characteristics may be similar to one or more of the techniques described in U.S. Pat. Nos. 4,427,363; 5,472,336; 6,509,838; 7,764,182; and 7,806,682, incorporated by reference above. As noted, the appliance's control electronics may use this information to make control decisions for the operation of the appliance, such as whether to open or close a gas valve. As used herein, the phrase "status of a flame" refers to any measurable characteristic of a flame or flame pattern, not just to the presence or absence of a flame. For example, the status of a flame may also refer to the strength or intensity of the flame, such as a high or low flame. Further, in some embodiments, information regarding the status of a flame may be used in conjunction with information from one or more temperature sensors.

In one embodiment, LED 120 may be selectively actuated by the control electronics of the fuel-fired heating appliance with which flame indicator assembly 100 is associated. Those of skill in the art are familiar with methods to provide for selective actuation of LED(s) 120, such as by using electronic components (e.g., resistors) to provide analog inputs to a microprocessor indicative of the amount of current flowing from the flame sensor. The microprocessor may then make a decision on how to illuminate the LED(s). Electrical communication between LED 120 and the control electronics (52) of the fuel-fired heating appliance may be via the same wire coupled with terminal 122 used by the control electronics to determine whether a flame is present. In other embodiments, LED 120 may be in electrical communication with the control electronics by a separate wire and terminal. In any event, in one example, when the control electronics determines that a flame is present, the control electronics may cause LED 120 to emit light, such as by applying power thereto. Likewise, when a flame is not present, the control electronics may deactivate LED 120. It will be appreciated that a variety of other methods of actuating one or more LED(s) 120 are within the scope of the invention. For example, the control electronics may cause LED 120 to blink at any frequency. Blinking at a slower frequency could signify low flame, for instance. Further, LED 120 may be illuminated in different colors depending on the status of the flame. Moreover, each LED 120 in a row of, for example, five LEDs 120 may be selectively illuminated to indicate the strength of a flame. Where no LEDs 120 are illuminated, no flame may be present; where one or two LEDs 120 are lighted, there may be a low flame; and so on.

In the illustrated embodiment, however, visual indicator module 110 may also comprise a control module 126 that is local to the flame sensor assembly and that selectively actuates LED 120 as described above independent of the control electronics of the fuel-fired heating appliance with which flame indicator assembly 100 is associated. In this regard, control module 126, which may include associated memory, may be similar to the control electronics on currently available control boards of fuel-fired heating appliances that evaluate information regarding the electrical characteristics of flame sensor 102 to determine the status of a burner flame. In other embodiments, however, control module 126 may be any commercially available processor or other logic machine capable of executing instructions, such as a general-purpose microprocessor or a digital signal processor (DSP).

In one embodiment, control module 126 and/or LED 120 may be powered via the wire extending between terminal 122 and the control electronics of a fuel-fired heating appliance, or another wire extending from the control electronics. In further embodiments, however, control module 126 and/or LED 120 may be powered via a suitable battery or other energy storage device in electronic communication therewith. In still other embodiments, control module 126 and/or LED 120 may be powered via a thermopile. In this regard, flame rod 104 may be formed of a suitable thermoelectric material, or flame sensor 102 may comprise a thermopile in the form of several thermocouples arranged in series or parallel. Alternatively, flame indicator assembly 100 may comprise a thermopile separate from or independent of flame sensor 102 to power control module 126 and/or LED 120.

According to yet another embodiment, a flame indicator assembly as described above may be provided as a "stand-alone" unit, independent of a conventional flame sensor otherwise provided in the fuel-fired heating appliance. In this case, the flame indicator assembly may be located at the burner assembly as described above, and it may or may not be in electrical communication with the appliance's control electronics. It may be powered by any method described above.

In this regard, visual indicator assembly 110 (or any component(s) thereof) need not be located at the proximal end 108 of flame rod 104. In some embodiments, for example, visual indicator assembly 110 could be located separate from flame sensor 102 and in communication therewith via suitable wired or wireless communication. This may facilitate placement of LED 120 to maximize visibility.

Figure 8:
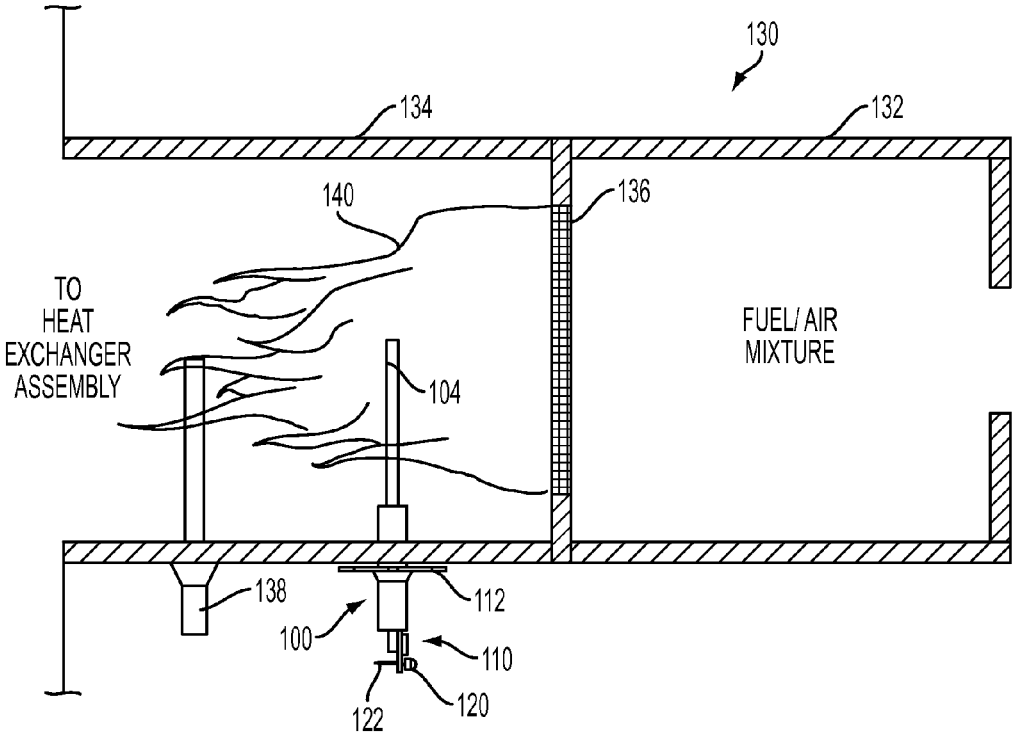
FIG. 8 is a schematic cross-sectional view through a portion of a premix burner assembly of a fuel-fired heating appliance including the flame indicator assembly of FIGS. 5-7 according to an embodiment of the present invention.

FIG. 8 is a schematic cross-sectional view through a premix burner assembly 130 which includes flame indicator assembly 100 according to one embodiment of the present invention. Burner assembly 130 is, in this embodiment, the same burner assembly 60 described above, except with respect to differences discussed herein, and thus burner assembly 130 may be assembled into a furnace or other fuel-fired heating appliance as described above with reference to FIGS. 1-3. Burner assembly 130 may define a mixing box 132 coupled with a burner box 134. A metal mesh burner 136 is positioned in burner box 134, and an igniter 138 extends into burner box 134. In addition, flame indicator assembly 100 is coupled with burner box 134 such that mounting plate 112 is affixed to an exterior wall of burner box 134 and flame rod 104 extends into burner box 134. Correspondingly, visual indicator assembly 110 of flame indicator assembly 100 is disposed exterior to burner assembly 130.

During firing of the heating appliance with which burner assembly 130 is associated, a flow of pre-mixed fuel and air is drawn through burner 136, as described above. The flow is caused to combust by igniter 138 to form an elongated flame pattern 140 emanating from the front side of burner 136. Because flame rod 104 is positioned such that it is within a volume of the burner assembly in which flame pattern 140 is expected during the furnace's normal operation, LED 120 of flame indicator assembly 100 may be actuated as described above to indicate that a flame is present. Notably, although it is not possible to visually observe a flame present in burner assembly 130, it is possible for a user of the fuel-fired heating appliance to know whether a flame is present via observation of LED 120 on flame indicator assembly 100. As shown in FIG. 8, visual indicator assembly 110 is disposed exterior to burner assembly 130 such that LED 120 is visible to the user at least when the user opens the housing of the fuel-fired heating appliance in which burner assembly 130 is installed.

Those of skill in the art are familiar with and can compensate for considerations relevant to placing a visual indicator assembly 110 at the burner assembly of a fuel-fired heating appliance. These include, for example, temperature effects on certain electronic components. It is observed, however, that because of the refractory material which lines the internal walls in certain premix burner assemblies, there are many areas on the exterior of these burner assemblies which, even during firing, are at a temperature that is suitably low for the proper operation of electronics of visual indicator assembly 110.

Figure 9:
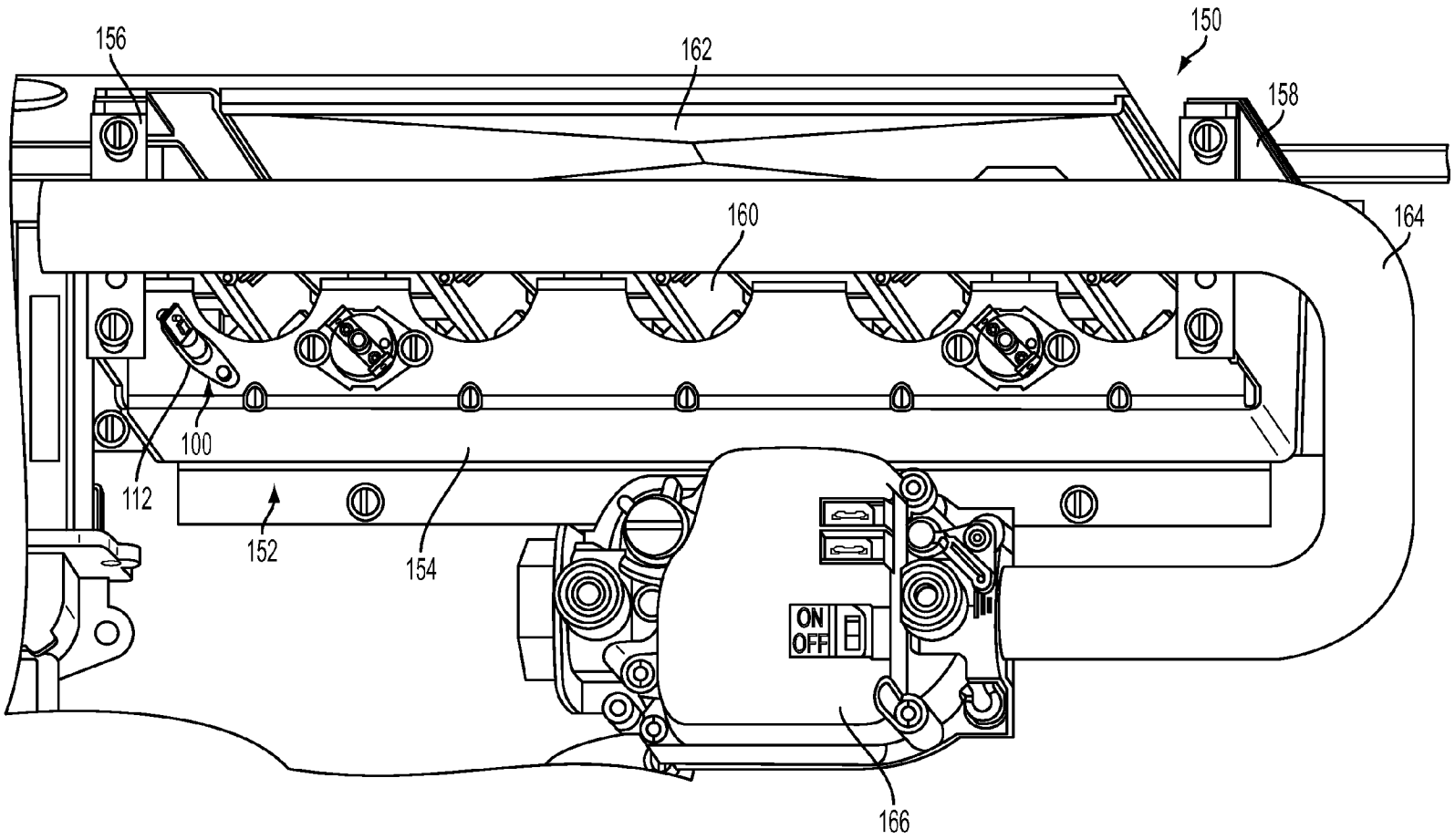
FIG. 9 is an enlarged perspective view of the bottom side of an in-shot burner assembly including the flame indicator assembly of FIGS. 5-7 according to an embodiment of the present invention.

Furthermore, embodiments of the present invention are not limited to use with premix burner assemblies. Rather, it is contemplated that embodiments may be used with any type of burner assembly. For example, FIG. 9 illustrates flame indicator assembly 100 in use with an inshot-type burner assembly 150 according to one embodiment of the present invention.

In this regard, burner assembly 150 comprises a generally "U"-shaped burner rack 152 comprising a shelf 154 that extends horizontally between two laterally opposed walls 156, 158. A burner 160, which may be analogous to the burner described in U.S. Pat. No. 5,833,449, the entire disclosure of which is incorporated by reference herein for all purposes, is coupled to shelf 154. Because the depth of shelf 154 is less than the depth of walls 156, 158, when burner 160 is coupled with shelf 154, a portion of burner 160 extends outwardly beyond shelf 154. Burner assembly 150 further comprises a cover 162, which may be secured over burner 160 via suitable fasteners coupled with walls 156, 158. Burner 160 may be supplied with hydrocarbon fuel (such as natural gas) through fuel supply piping coupled to a supply manifold 164. A gas valve 166 is coupled along the fuel supply piping upstream of manifold 164.

In this embodiment, flame indicator assembly 100 is coupled with burner assembly 150 via mounting plate 112, which is coupled with shelf 154 via suitable fasteners. Although not shown in FIG. 9, flame rod 104 of flame indicator assembly 100 extends into burner assembly 150 beneath burner 160 and suitably proximate or within the flame pattern of burner 160 when ignited. In operation, when burner assembly 150 is fired, LED 120 may be illuminated in response to detection of a flame in burner assembly 40. Therefore, a user of this appliance may quickly visually inspect the status of the flame at burner assembly 150. Further, the status of the flame is evident at burner assembly 150 without the need for a sight glass or another means to observe the flame itself.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

What is claimed is:

1. A flame indicator assembly for a fuel-fired heating appliance, the fuel-fired heating appliance comprising a burner assembly comprising at least one burner, wherein the burner assembly completely encloses a flame at the at least one burner, and control electronics, the flame indicator assembly comprising:

a flame sensor configured to allow flow of electric current in response to exposure to the flame, the flame sensor configured for electrical communication with the control electronics of the fuel-fired heating appliance;

a visual indicator module attached to the flame sensor, the visual indicator module comprising at least one light source; and a mounting bracket to which the flame sensor and the visual indicator module are mounted and that is configured to be attached to the burner assembly, wherein the visual indicator module is in operative communication with the flame sensor so that the at least one light source is actuated in response to the flow of electric current.

2. The flame indicator assembly of claim 1, wherein the flame sensor is a rectification flame sensor.

3. The flame indicator assembly of claim 2, the flame sensor further comprising a flame rod.

4. The flame indicator assembly of claim 3, wherein the flame rod has a first end and a second end, and when the flame indicator assembly is coupled with the burner assembly by the mounting bracket, the first end is located exterior to the burner assembly and the second end is located within the burner assembly.

5. The flame indicator assembly of claim 4, wherein the visual indicator module is coupled to the first end of the flame rod.

6. The flame indicator assembly of claim 1, wherein the at least one light source is a light-emitting diode.

7. The flame indicator assembly of claim 1, wherein the control electronics operatively connect the flame sensor to the visual indicator module so that the control electronics actuate the at least one light source in response to the flow of electric current.

8. The flame indicator assembly of claim 1, further comprising a control module configured to evaluate electrical characteristics of a flame in response to the flow of electric current.

9. The flame indicator assembly of claim 8, wherein the control module actuates the at least one light source in response to the flow of electric current.

10. The flame indicator assembly of claim 9, further comprising a battery to power the control module.

11. The flame indicator assembly of claim 9, further comprising a thermopile to power the control module.

12. A fuel-fired heating appliance, comprising:

a housing;

a burner assembly disposed in the housing, the burner assembly comprising at least one burner wherein the burner assembly completely encloses a flame at the at least one burner;

a heat exchanger assembly disposed in the housing, the heat exchanger assembly comprising at least one combustor tube disposed proximate the at least one burner;

control electronics disposed in the housing, the control electronics configured to control actuation of the burner assembly; and a flame indicator assembly coupled with the burner assembly, the flame indicator assembly comprising a flame sensor configured to allow flow of electric current in response to exposure to the flame and disposed at the burner assembly so that the flame sensor allows the flow of electric current in response to exposure to the flame at the at least one burner, the flame sensor in electrical communication with the control electronics, a visual indicator module attached to the flame sensor, the visual indicator module comprising at least one light source, and a mounting bracket to which the flame sensor and the visual indicator module are mounted and that is attached to the burner assembly, wherein the visual indicator module is in operative communication with the flame sensor such that the at least one light source actuates in response to the flow of electric current.

13. The fuel-fired heating appliance of claim 12, wherein the control electronics selectively actuate the at least one light source in response to the flow of electric current.

14. The fuel-fired heating appliance of claim 12, wherein the at least one light source is a light-emitting diode.

15. The fuel-fired heating appliance of claim 12, wherein the fuel-fired heating appliance is a furnace.

16. The fuel-fired heating appliance of claim 12, wherein the fuel-fired heating appliance is a water heater.

17. The fuel-fired heating appliance of claim 12, wherein the fuel-fired heating appliance is a boiler.

18. The flame indicator assembly of claim 12, wherein the flame sensor is a rectification flame sensor.

19. The flame indicator assembly of claim 18, the flame sensor further comprising a flame rod.

20. The flame indicator assembly of claim 19, wherein the flame rod has a first end and a second end, when the flame indicator assembly is coupled with the burner assembly by the mounting bracket, the first end is located exterior to the burner assembly and the second end is located within the burner assembly, and the visual indicator module is coupled to the first end of the flame rod.

21. The flame indicator assembly of claim 12, wherein the control electronics operatively connect the flame sensor to the visual indicator module so that the control electronics actuate the at least one light source in response to the flow of electric current.

22. The flame indicator assembly of claim 12, further comprising a control module configured to evaluate electrical characteristics of a flame in response to the flow of electric current.

23. The flame indicator assembly of claim 22, wherein the control module actuates the at least one light source in response to the flow of electric current.

* * * * *